US007182694B2

(12) United States Patent
Ochi

(10) Patent No.: US 7,182,694 B2
(45) Date of Patent: Feb. 27, 2007

(54) PLAY APPARATUS

(75) Inventor: Yasushi Ochi, Izumisano (JP)

(73) Assignee: BLD Oriental, Ltd., Izumisano (JP)

( * ) Notice: Subject to any disclaimer, the term of this patent is extended or adjusted under 35 U.S.C. 154(b) by 0 days.

(21) Appl. No.: 10/906,777

(22) Filed: Mar. 7, 2005

(65) Prior Publication Data

US 2006/0199655 A1 Sep. 7, 2006

(51) Int. Cl.
*A63G 1/10* (2006.01)

(52) U.S. Cl. ..... 472/29; 472/33

(58) Field of Classification Search ..... 472/29, 472/32, 33, 6–8, 10, 130, 131, 135, 136; 482/33, 35

See application file for complete search history.

(56) References Cited

U.S. PATENT DOCUMENTS 3,090,617 A * 5/1963 Hjelte et al. ..... 482/143
3,598,403 A * 8/1971 Bartlett ..... 472/39
5,997,403 A * 12/1999 Fonti ..... 472/19

* cited by examiner

*Primary Examiner*—Kien Nguyen
(74) *Attorney, Agent, or Firm*—M & J IP Assoc.

(57) ABSTRACT

A play facility (1) includes a rotation shaft (25) erected on a floor inside the play facility, the rotation shaft being rotatable (25) around its axis; a brush-like decorative object (33) attached to a circumferential periphery of the rotation shaft (25); and a driving means for rotating the rotation shaft (25) around its axis. A play participant can play while holding on to the rotation shaft (25) to which the decorative object (33) is attached.

4 Claims, 7 Drawing Sheets

PLAY APPARATUS

BACKGROUND OF THE INVENTION

1. Technical Field

The present invention relates to play facilities for installation in children's areas in amusement parks, department stores, supermarkets, or the like.

2. Description of the Related Art

As a play facility that can be set up in children's areas of amusement parks, department stores or supermarkets or the like, the inventors have already proposed a play facility, in which bag-like containers made of flexible sheets are filled with a pliable substance or a powder and/or a liquid, the ductile objects formed by removing the air from the containers are spread on the floor of a play space, and play participants can climb onto and play on the spread ductile objects. (Cf. Japanese Unexamined Pat. App. Pub. No. 2000-116961A.)

With this play facility, the play participants can make dents in the ductile objects or let them bulge up at one place, as if playing with Playdough™. Also, the pliable substance or powder filled into the containers does not come in direct contact with the play participants, so that it will not soil clothes or body, which is hygienic.

In this play facility, the pliable substance or powder is filled into the bag-like containers, so that there is no risk of it becoming scattered around the play facility, which means that the play facility can be set up without problems at an indoor children's area.

In this regard, a number of play facilities suitable for children above a certain height have been proposed, but in spite of the above-described play facility, there are not many facilities that are adequately suitable for toddlers. Moreover, there are few play facilities that can be set up indoors.

BRIEF SUMMARY OF THE INVENTION

It is thus an object of the present invention to rectify this situation and to provide a play facility that can be played on by small children and that can be set up indoors.

In order to attain the above objects, a play facility in accordance with the present invention comprises a rotation shaft erected on a floor inside the play facility, the rotation shaft being rotatable around its axis; a brush-like decorative object attached to a circumferential periphery of the rotation shaft; and a driving means for rotating the rotation shaft around its axis; wherein a play participant can play while holding on to the rotation shaft to which the decorative object is attached.

With the play facility according to this configuration, the rotatable rotation shaft having the brush-like decorative object attached to its circumferential periphery and standing erect on the floor is rotated around its axis by the driving means, and the play participant can engage in such play as holding on to the rotating rotation shaft.

If the decorative object is made of soft fibers (or straps, or feathers), then the play participant can experience the sensation of being buried in the brush-like decorative object while holding on to the rotation shaft, with the brush-like decorative object brushing along the play participant's body, or the play participant can experience being rotated together with the rotation shaft. Especially for smaller children, such as toddlers, this will be a novel sensation that they have not experience before, and will therefore be double the fun.

The decorative object may also be shaped like a geometrical solid. With such a decorative object, the play participant can cling to the geometrically decorative object, or hold on to the rotation shaft while riding on the decorative object. Similar to the above, for smaller children, this will be a new kind of play that they have not experience before.

Also, the rotation shaft may be suspended from a ceiling inside the play facility. Also in this case, similar effects as described above can be attained. Also, the rotation shaft does not have to be rigid, but may be flexible or made of a bendable or pliable material.

As explained above, the present invention provides a play facility with which in particular younger children such as toddlers can partake in novel play activities that they have not experience before. Also, the configuration of the play facility is simple, so that it can be set up without problem in an indoor children's area.

From the following detailed description in conjunction with the accompanying drawings, the foregoing and other objects, features, aspects and advantages of the present invention will become readily apparent to those skilled in the art.

DETAILED DESCRIPTION OF THE INVENTION

Figure 1:
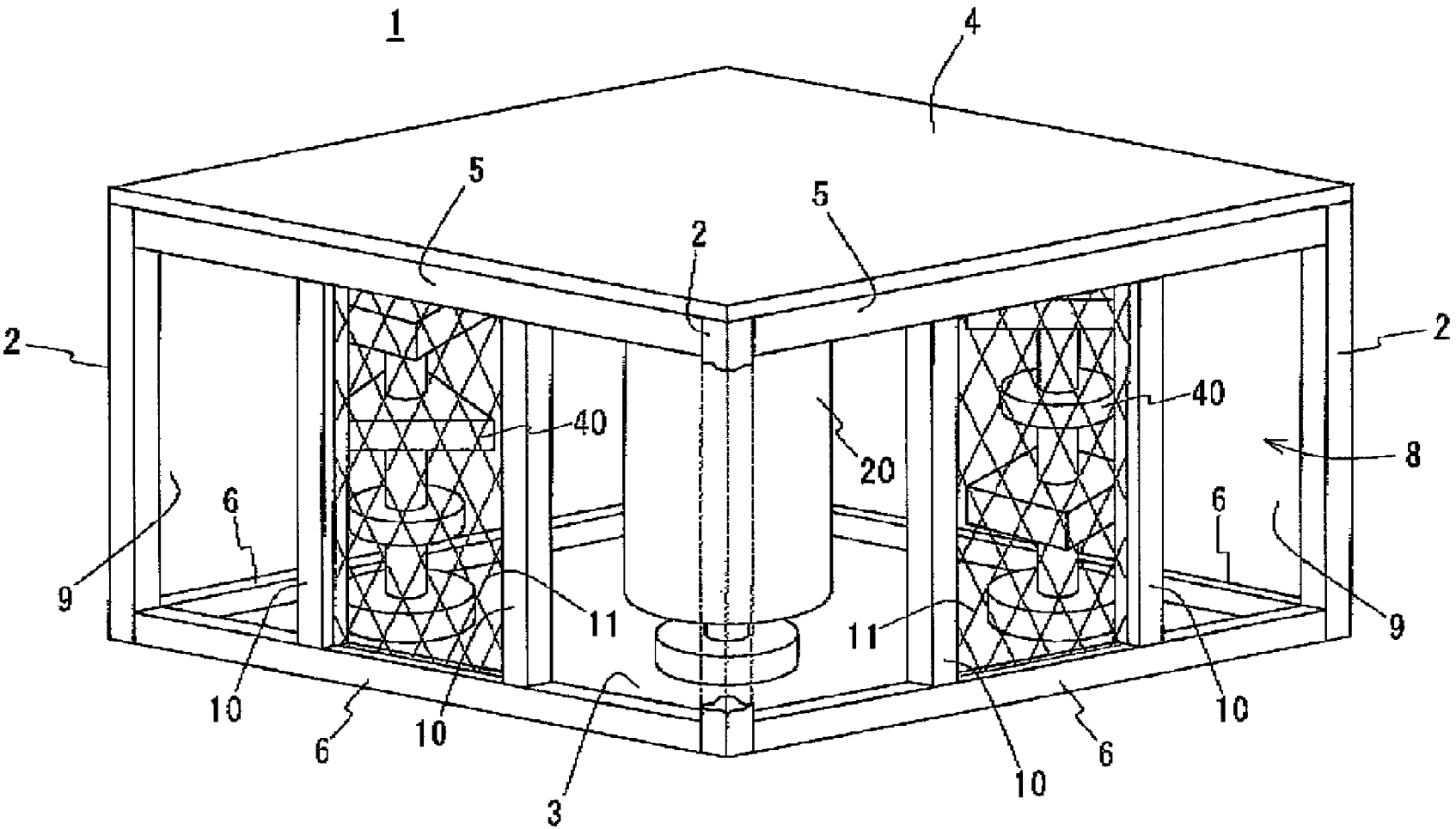
FIG. 1 is a perspective view of an entire play facility according to an embodiment of the present invention.
Figure 2:
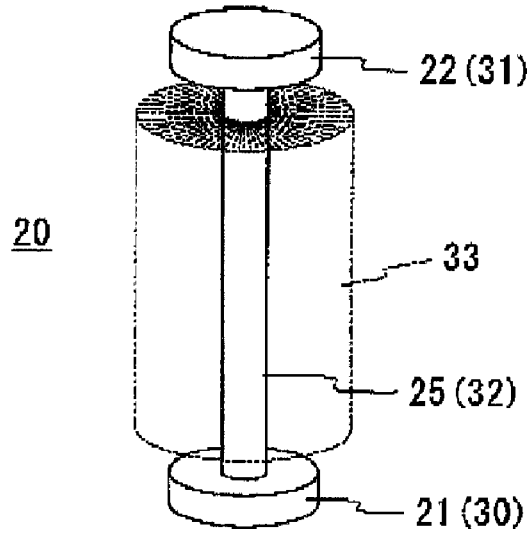
FIG. 2 is a perspective view of a first rotation structure according to this embodiment.
Figure 3:
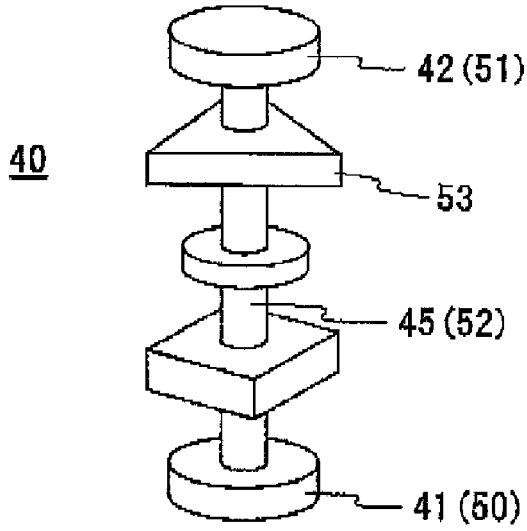
FIG. 3 is a perspective view of a second rotation structure according to this embodiment.
Figure 4:
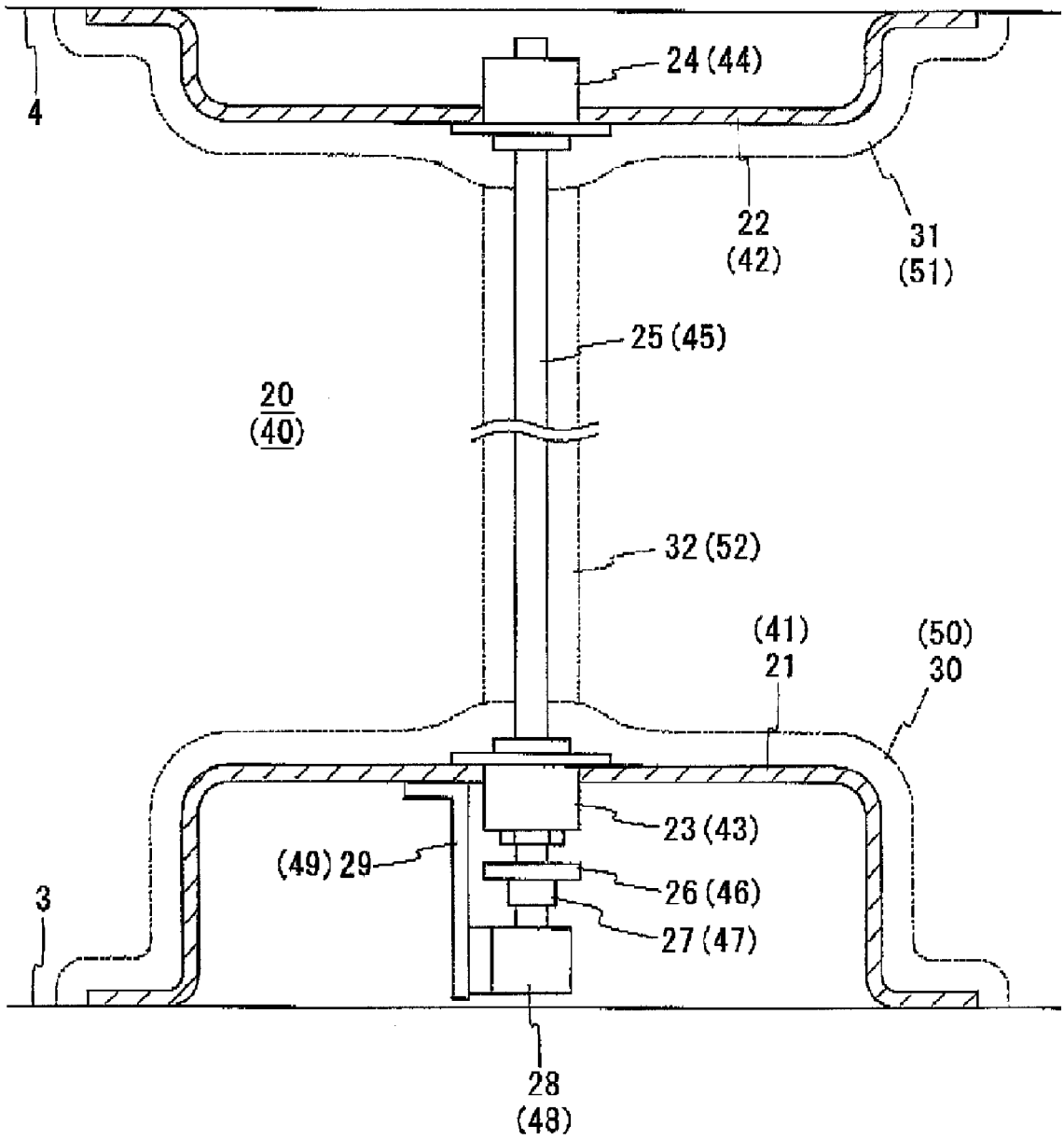
FIG. 4 is a longitudinal sectional view of a rotation structure that is the same in the first rotation structure and the second rotation structure of this embodiment.

The following is a description of specific embodiments of the present invention, with reference to the accompanying drawings. FIG. 1 is a perspective view of an entire play facility according to an embodiment of the present invention. FIG. 2 is a perspective view of a first rotation structure according to this embodiment, and FIG. 3 is a perspective view of a second rotation structure according to this embodiment. FIG. 4 is a longitudinal sectional view of the rotation structure, which is the same in the first rotation structure and the second rotation structure.

As shown in FIG. 1, a play facility 1 according to this example includes a play space 8 constituted by support poles 2 erected at four locations, a floor member 3, a ceiling member 4, and beams 5 and 6. A first rotation structure 20 and a second rotation structure 40 are arranged inside this play space 8.

It should be noted that walls 9, pillars 10 and nets 11 affixed to the pillars 10 are arranged between the support poles 2.

As shown in FIGS. 2 and 4, the first rotation structure 20 is made of a lower base 21 that is placed on the floor member 3, an upper base 22 fixed to the lower surface of the ceiling member 4, a bearing 23 fixed to the lower base 21, a bearing 24 fixed to the upper base 22, a rotation shaft 25 arranged in an erect orientation and supported rotatively by these bearings 23 and 24, a drive motor 28 driving the rotation shaft 25 around its center axis, an attachment member 29 fixing the drive motor 28 to the lower base 21, a friction clutch 26 and a coupling 27 disposed between the output shaft of the drive motor 28 and the rotation shaft 25 and transmitting the driving source of the drive motor 28 to the rotation shaft 25, a cover member 32 formed by covering an urethane sponge with a vinyl sheet and covering the circumferential periphery of the rotation shaft 25, a brush-like decorative object 33 fixed to the circumferential periphery of the cover member 32, a cover member 30 covering the lower base 21, and a cover member 31 covering the upper base 22, the cover members 30 and 31 also being made of a urethane sponge covered with a vinyl sheet.

The decorative object 33 may be made by attaching fibers, straps or feathers in a brush-like fashion to the rotation shaft 25.

As shown in FIGS. 3 and 4, the second rotation structure 40 is similarly made of a lower base 41 that is placed on the floor member 3, an upper base 42 fixed to the lower surface of the ceiling member 4, a bearing 43 fixed to the lower base 41, a bearing 44 fixed to the upper base 42, a rotation shaft 45 arranged in an erect orientation and supported rotatively by these bearings 43 and 44, a drive motor 48 driving the rotation shaft 45 around its center axis, an attachment member 49 fixing the drive motor 48 to the lower base 41, a friction clutch 46 and a coupling 47 disposed between the output shaft of the drive motor 48 and the rotation shaft 45 and transmitting the driving source of the drive motor 48 to the rotation shaft 45, a cover member 42 formed by covering an urethane sponge with a vinyl sheet and covering the circumferential periphery of the rotation shaft 45, decorative objects 53 attached to the circumferential periphery of the rotation shaft 45 and shaped like geometric solids, a cover member 50 covering the lower base 41, and a cover member 51 covering the upper base 42, the cover members 50 and 51 also being made of a urethane sponge covered with a vinyl sheet.

Each of the decorative objects 53 is made of a skeleton member shaped like a geometrical solid, such as a disk or a prism, and is covered by a cover member made by covering an urethane sponge with a vinyl sheet. The skeleton member is fixed to the rotation shaft 45.

A mattress made by covering an urethane sponge with a vinyl sheet is spread on the floor member 3. The lower face of the ceiling member 4 and the inner side of the walls 9 are covered by cover members similarly made by covering an urethane sponge with a vinyl sheet, and the support pillars 2 and the pillars 10 are also covered by cover members of a similar structure.

Thus, with this play facility 1, first the rotation shaft 25 of the first rotation structure 20 is driven by the drive motor 28, and the rotation shaft 45 of the second rotation structure 40 is driven by the drive motor 48.

Then, the play participant enters the play space 8, in which the rotation shafts 25 and 45 are rotated in this manner, and can engage in play by holding on to the rotation shaft 25 to the outer side of which the brush-like decorative object 33 is attached, or clinging to the geometrically decorative objects 53 attached to the rotation shaft 45, or holding on to the rotation shaft 45 while riding on the decorative objects 53.

The decorative object 33 is made of a soft material, shaped like fibers, straps or feathers, and by holding on to the rotation shaft 25, the play participant can experience the sensation of being buried in the brush-like decorative object 33, with the brush-like decorative object 33 brushing along the play participant's body. Or, the play participant can experience being rotated together with the rotation shaft 25 or 45. Especially for smaller children, such as toddlers, this sensation will be a novel sensation that they have not experienced before, and will therefore be double the fun.

The configuration of the play facility is simple, so that it can be set up without problem in an indoor children's area or the like.

When more than a predetermined number of play participants hold on to the rotation shaft 25, 45, an excessive load may act on the drive motor 28, 48, which may pose the danger of damaging it, but in this example, a friction clutch 26, 46 is interposed between the rotation shaft 25, 45 and the drive motor 28, 48. Thus, when the load becomes too large, a coupling portion of the friction clutch 26, 46 assumes a sliding contact state, the drive motor 28, 48 assumes an idling state, and damage of the drive motor 28, 48 is prevented through this operation of the friction clutch 26, 46.

The foregoing was an explanation of an embodiment of the present invention, but there is no limitation to the specific configurations that can be adopted for the present invention.

Figure 5:
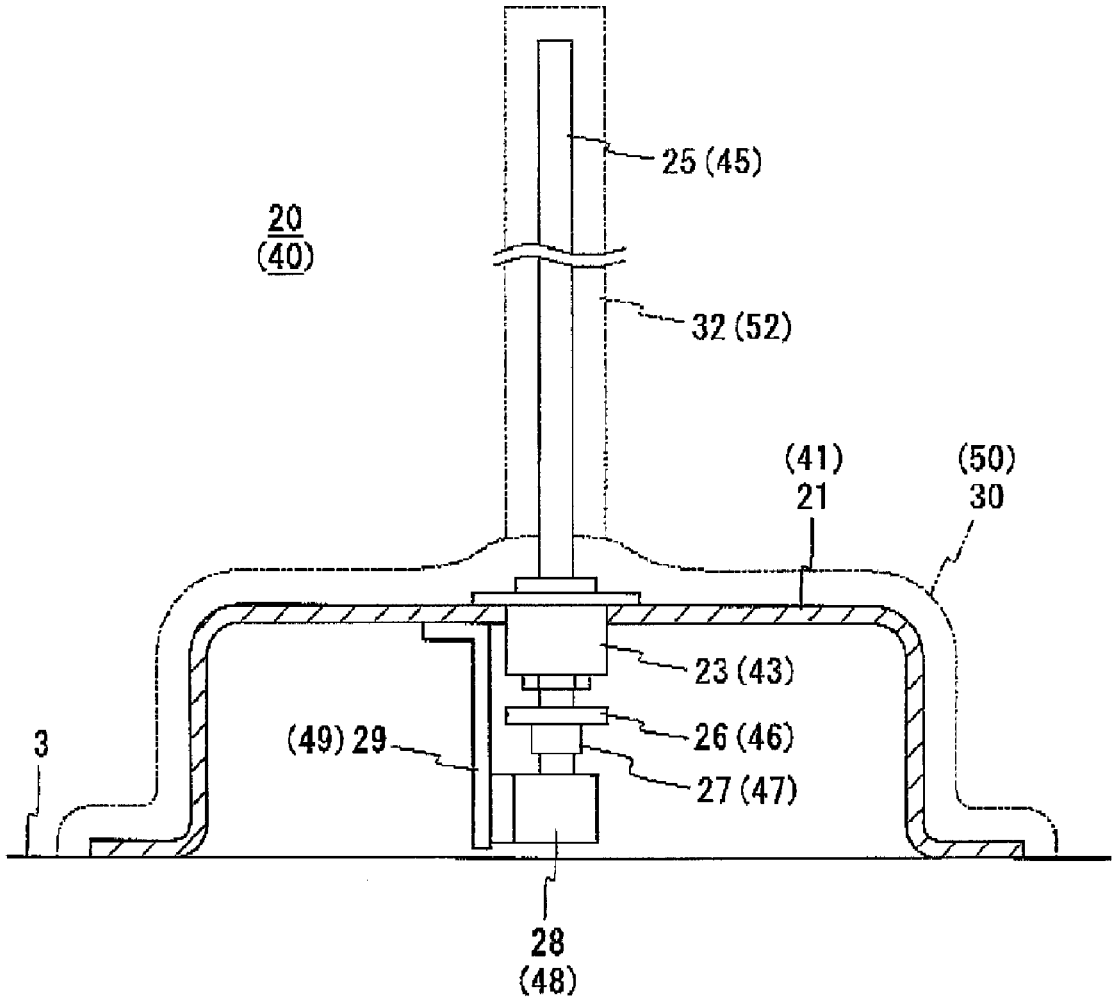
FIG. 5 is a longitudinal sectional view of a rotation structure that is the same in the first rotation structure and the second rotation structure according to another embodiment of the present invention.
Figure 6:
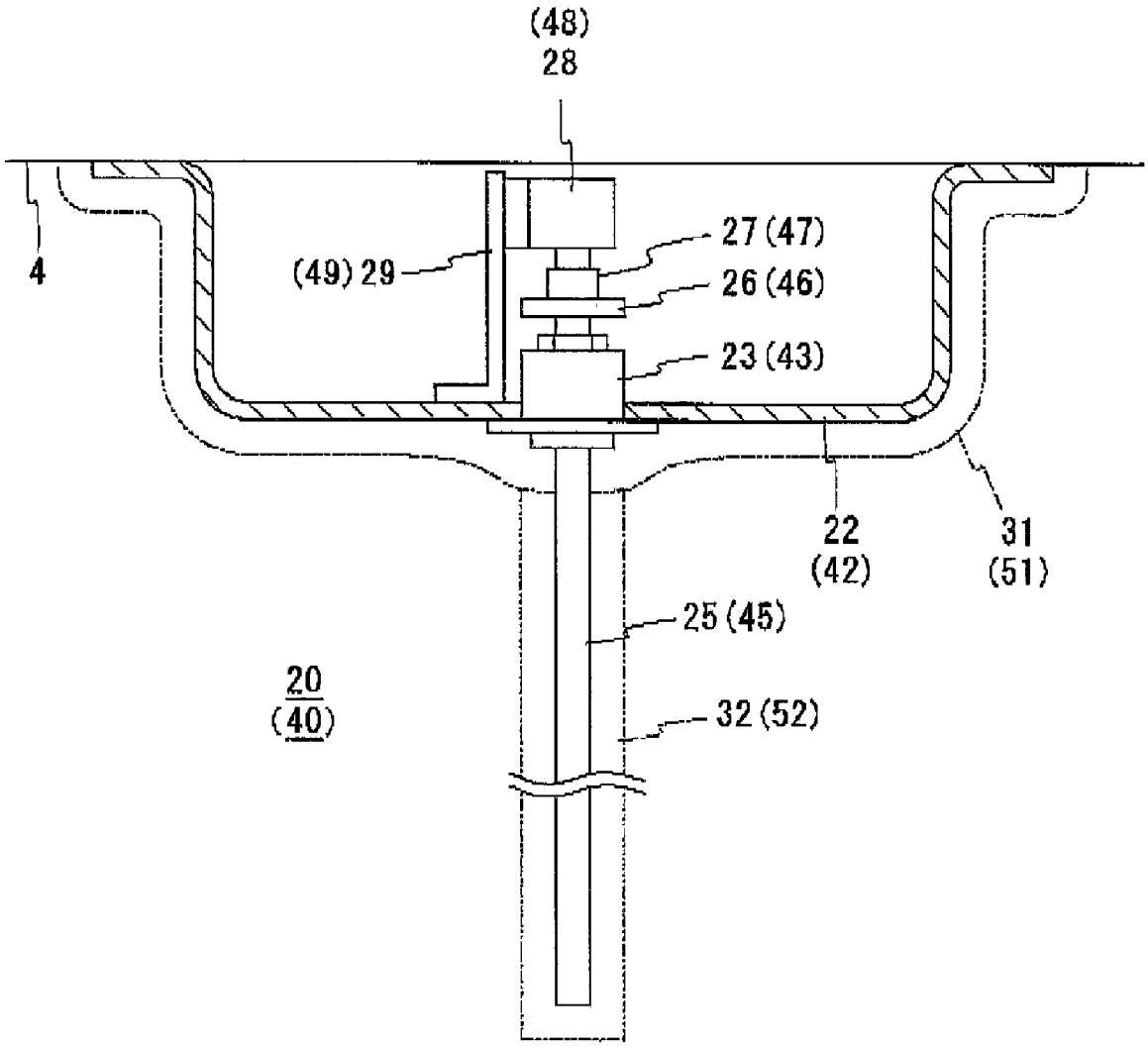
FIG. 6 is a longitudinal sectional view of a rotation structure that is the same in the first rotation structure and the second rotation structure according to another embodiment of the present invention.

For example, in the above example, the rotation shafts 25 and 45 are supported by the floor member 3 and the ceiling member 4, but it is also possible to adopt a configuration in which the rotation shafts 25 and 45 are not supported by the ceiling member 4, but stand erect on the floor member 3 as shown in FIG. 5, or in which the rotation shafts 25 and 45 are suspended vertically from the ceiling member 4, as shown in FIG. 6. Also in this case, the same effect as described for the foregoing example can be attained. It should be noted that in FIGS. 5 and 6, the same reference numerals are used for structural elements that are the same as in the foregoing example, and their further explanation has been omitted.

Also, the rotation shafts 25 and 45 in the above examples are not limited to rigid shafts, but may also have a certain degree of flexibility, such as wire springs or elastic bars, and they may also be made of a bendable or pliable material. Thus, loads applied by the play participants can cause the rotation shafts 25 and 45 to swing, thus further increasing the play possibilities.

Figure 7:
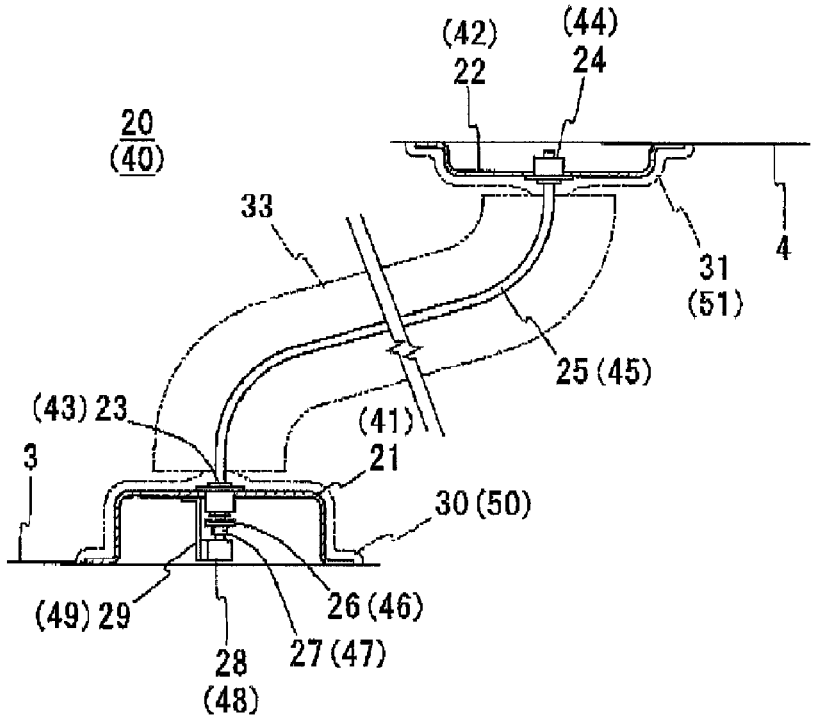
FIG. 7 is a longitudinal sectional view of a rotation structure that is the same in the first rotation structure and the second rotation structure according to another embodiment of the present invention.
Figure 8:
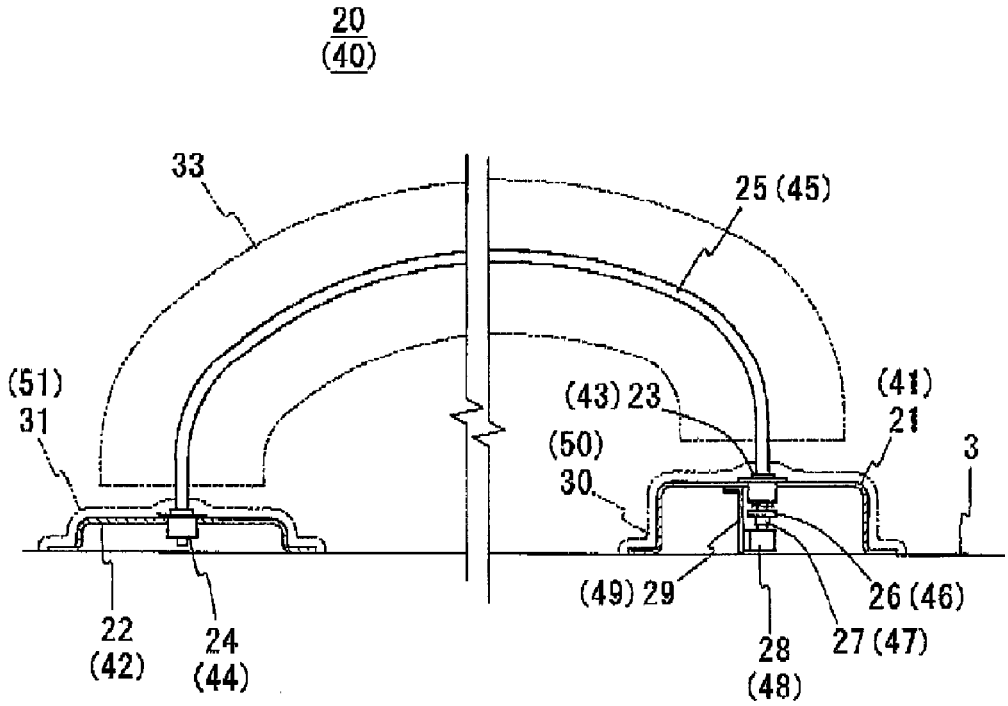
FIG. 8 is a longitudinal sectional view of a rotation structure that is the same in the first rotation structure and the second rotation structure according to another embodiment of the present invention.

In this case, there may be a horizontal shift between the position where the rotation shafts 25 and 45 are supported by the floor member 3 and the position where they are supported by the ceiling member 4, as shown in FIG. 7, thus curving the rotation shafts 25 and 45 to an S-shape, or the rotation shafts 25 and 45 may be curved to a U-shape, with both ends of the rotation shafts 25 and 45 being supported by the floor member 3, as shown in FIG. 8. Alternatively, in a configuration that is not shown in the drawings, the rotation shafts 25 and 45 may be curved to a U-shape, with both ends of the rotation shafts 25 and 45 being supported by the ceiling member 4.

Figure 9:
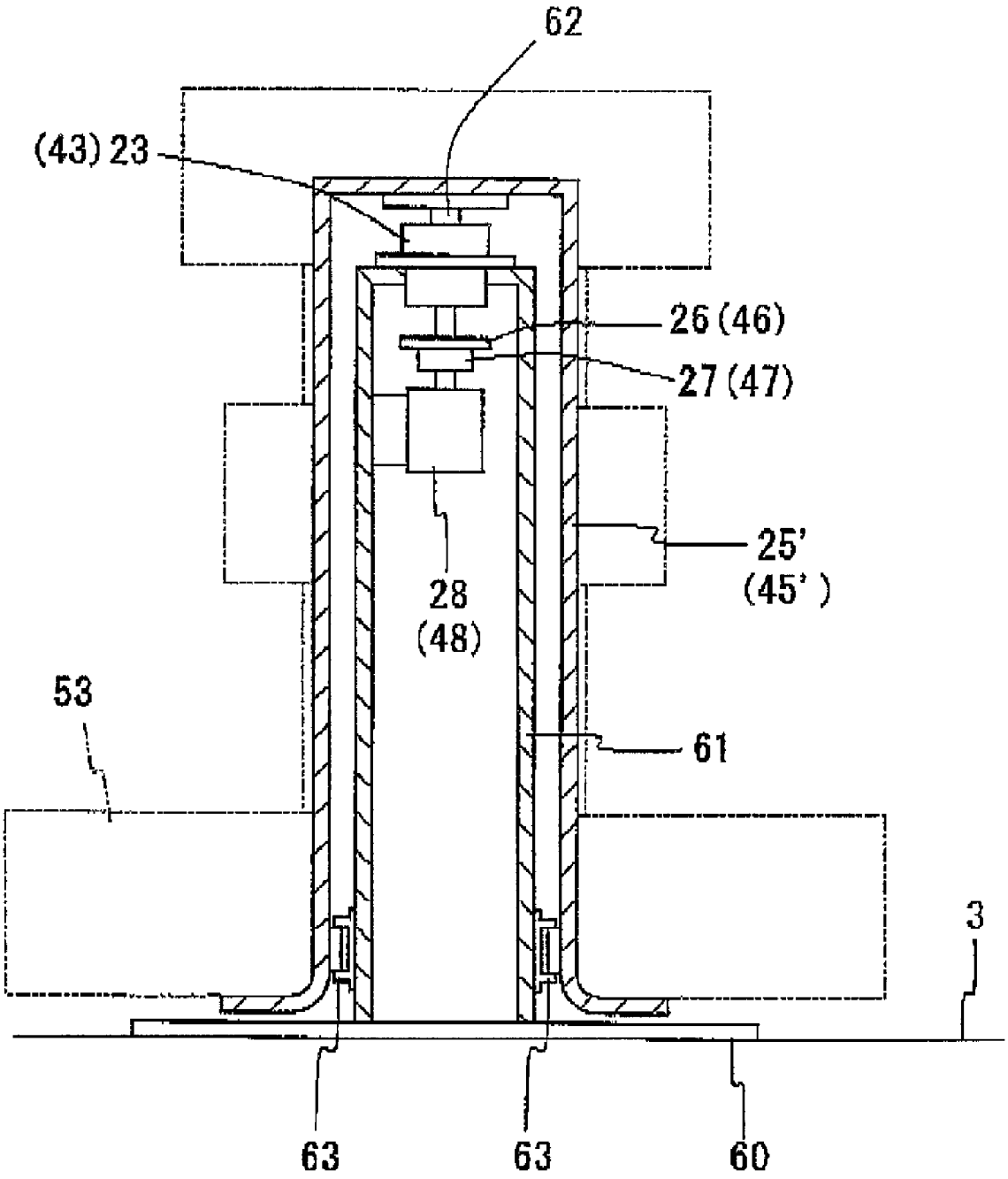
FIG. 9 is a longitudinal sectional view of a rotation structure that is the same in the first rotation structure and the second rotation structure according to another embodiment of the present invention.

The structure for supporting and rotating the rotation shaft may also be as shown in FIG. 9. In this example, the rotation shaft 25', 45' is made of a tubular member, which is supported by a similarly tubular support post 61 standing erect on the floor member 3 and inserted into this tubular member. The drive motor 28, 48 is disposed inside the support post 61. A linking shaft 62 attached to the inner face of the rotation shaft 25', 45' pierces the upper end of the support post 61 and is supported rotatively by a fixed bearing 23, 43. The linking shaft 62 is linked via a friction clutch 26, 46 and a coupling 27, 47 to the output shaft of the drive motor 28, 48. The support post 61 stands erect on a base plate 60 placed on the floor member 3. Also, numeral 63 in FIG. 9 denotes guide rollers guiding the rotation of the rotation shafts 25' and 45'.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A play facility comprising:

a cylindrical rotation shaft erected on a floor inside the play facility to allow the rotation shaft to rotate on its center axis;

a driving means for rotating the rotation shaft on its center axis; and a cylindrical brush-like decorative object attached to and extending along the cylindrical periphery of the rotation shaft, said brush-like decorative object flexible enough to yield to a play participants' body such that the play participant can hug onto the rotation shaft directly, or through the decorative object, to ride on the rotating shaft.

2. A play facility comprising:

a cylindrical rotation shaft erected on a floor inside the play facility to allow the rotation shaft to rotate on its center axis;

a driving means for rotating the rotation shaft on its center axis; and a plurality of decorative objects in the form of geometrical solids, said decorative objects attached to and spaced apart along the cylindrical periphery of the rotation shaft and each decorative object being pliable enough to allow a play participant to cling onto the object, yet strong enough so that the play participant can ride on the rotating shaft while clinging onto the object.

3. A play facility comprising:

a cylindrical rotation shaft suspended from a ceiling inside the play facility and supported by the ceiling to allow the shaft to rotate on its center axis;

a driving means for rotating the rotation shaft on its center axis; and a cylindrical brush-like decorative object attached to and extending along the cylindrical periphery of the rotation shaft, said brush-like decorative object flexible enough to yield to a play participants' body such that the play participant can hug onto the rotation shaft directly, or through the decorative object, to ride on the rotating shaft.

4. A play facility comprising:

a cylindrical rotation shaft suspended from a ceiling inside the play facility and supported by the ceiling to allow the shaft to rotate on its center axis;

a driving means for rotating the rotation shaft on its center axis; and a plurality of decorative objects in the form of geometrical solids, said decorative objects attached to and spaced apart along the cylindrical periphery of the rotation shaft and each decorative object being pliable enough to allow a play participant to cling onto the object, yet strong enough so that the play participant can ride on the rotating shaft while clinging onto the object.

* * * * *